United States Patent [19]

Upmeier

[11] Patent Number: 4,926,769

[45] Date of Patent: May 22, 1990

[54] AUTOMATIC SEWING DEVICE WITH A SEWING HEAD INCLUDING A ROTARY HOUSING

[75] Inventor: Egon Upmeier, Lage-Kachtenhausen, Fed. Rep. of Germany

[73] Assignee: Kochs Adler Aktiengesellschaft, Fed. Rep. of Germany

[21] Appl. No.: 359,874

[22] Filed: May 31, 1989

[30] Foreign Application Priority Data

Jun. 11, 1988 [DE] Fed. Rep. of Germany ..... 3819975

[51] Int. Cl.[5] ..... D05B 39/00; D05B 69/28

[52] U.S. Cl. ..... 112/121.12; 112/220; 112/309

[58] Field of Search ..... 112/121.11, 121.12, 112/121.15, 220, 258, 259, 309

[56] References Cited

U.S. PATENT DOCUMENTS

| | | | |
|---|---|---|---|
| 4,553,489 | 11/1985 | Landwehr | 112/121.12 |
| 4,574,718 | 3/1986 | Scholl et al. | 112/121.12 |
| 4,674,421 | 6/1987 | Iwase | 112/121.12 |
| 4,787,324 | 11/1988 | Fischer et al. | 112/121.12 |
| 4,787,326 | 11/1988 | Scholl et al. | 112/121.12 X |
| 4,817,543 | 4/1989 | Fischer | 112/121.12 |

FOREIGN PATENT DOCUMENTS

| | | | |
|---|---|---|---|
| 3538461 | 5/1986 | Fed. Rep. of Germany | 112/ |
| 3625881 | 4/1988 | Fed. Rep. of Germany | 112/220 |
| 277990 | 12/1987 | Japan | 112/121.11 |

*Primary Examiner*—Werner H. Schroeder
*Assistant Examiner*—David K. Suto
*Attorney, Agent, or Firm*—Laff, Whitesel, Conte & Saret

[57] ABSTRACT

In an automatic sewing device the sewing head has, for producing a tangential path of the needle relative to the seam to be produced, a rotary housing which receives the needle bar and a likewise rotatable hook bearing which receives the hook and which can be tilt driven by an adjusting shaft at the same angle of rotation as the rotary housing. A drive shaft is provided for driving the needle bar and the hook. To enable even pivoting movements of the rotary housing in a simple embodiment without a change in the height of the needle bar occurring, there are provided a device for the drive-like connection of the adjusting shaft and the drive shaft and a device for the disengagement of the drive motor from the drive shaft.

9 Claims, 5 Drawing Sheets

AUTOMATIC SEWING DEVICE WITH A SEWING HEAD INCLUDING A ROTARY HOUSING

FIELD OF THE INVENTION

In general this invention relates to an automatic sewing device for generating a stitch contour on a workpiece according to a pre-given program.

In particular this invention relates to an automatic sewing device with a sewing head and a device for generating a two-axis-relative movement between the sewing head and the workpiece to be sewn wherein the sewing head is provided with a rotary housing supported at the sewing head and drivable in a swivelling manner by an adjusting shaft, said rotary housing having a needle bar with a needle supported in the rotary housing and reciprocatingly drivable via a crank drive driven by a common drive, which in turn is driven by a drive shaft of the sewing head, a needle jogging gear connected to the crank drive for generating a needle feed movement, and a thread take-up lever drive coupled to the crank drive for the needle bar. A hook bearing is drivable in a swivelling manner by the adjusting shaft about a common axis of the needle and the hook bearing respectively equiangularly to the rotary housing. A hook is arranged in the hook bearing and drivable by the drive shaft. Furthermore, a drive motor for driving the drive shaft and an adjustable drive for driving the adjusting shaft are provided.

BACKGROUND OF THE INVENTION

With an automatic sewing device of this type which is known from U.S. Pat. No. 4,787,324, the needle bar drive, needle oscillating drive and thread take-up lever, on the one hand, and the hook, on the other hand, are adjusted in a like manner during pivoting movements of the rotary housing and hook bearing at the same angle of rotation so that in the rotary housing, on the one hand, and in the hook bearing, on the other hand, the changes in position of the said parts which are triggered in themselves by the pivoting movements are compensated for. With this known embodiment the drive motor and a servomotor act on a differential gear which connects the drive shaft and the adjusting shaft to one another.

In the case of an embodiment according to U.S. Pat. No. 4,787,326 which is of the same generic type this compensating action is brought about by an actuating drive which is connected only to the adjusting shaft and is triggered accordingly by a central control unit.

A further problem with these automatic sewing devices of the type as defined is that it must be possible to produce so-called corner stitches in which case the rotary housing is guided with the needle inserted.

From German published patent application No. 35 38 461 it is known practice to provide a coupling device in a sewing machine having a rotary housing in order to connect the actuating drive to the needle bar drive in order to prevent adjustments of the needle bar resulting from rotary movements of the rotary housing. It is not known how operativeness is to be achieved.

SUMMARY OF THE INVENTION

It is an object of the invention to provide an automatic sewing device of the type as defined in such a manner that with the simple design even swivelling movements of the rotary housing are possible without a variation in the height of the needle bar occurring.

This object is achieved in accordance with the invention by a device for a drive-like connection of the adjusting shaft and the drive shaft and a device for the disengaging of the drive motor from the drive shaft. The measures according to the invention make it possible to use a particularly simple commercially available drive motor for sewing machines having a two-quadrant control system and, on the other hand, to dispense with the use of a differential gear. If so-called corner stitches are to be produced, the drive motor firstly is released and, secondly, a driving connection is formed between the control shaft and the drive shaft.

Further advantages and features of the invention will become apparent from the ensuing description of two exemplary embodiments, taken in conjunction with the drawings.

DESCRIPTION OF THE PREFERRED EMBODIMENTS

Figure 1:
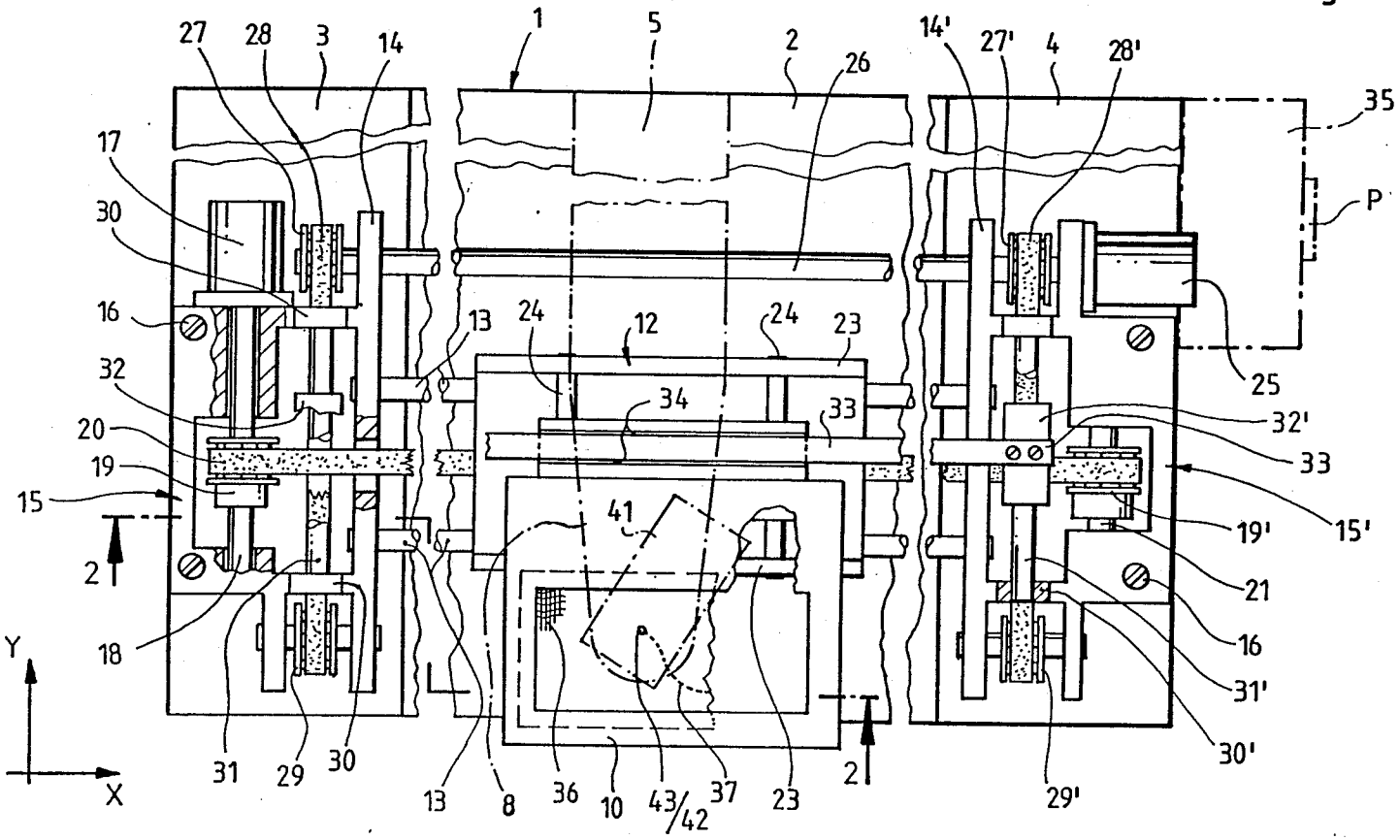
FIG. 1 shows an automatic sewing machine according to the invention in plan view in the direction of arrow I in FIG. 2, with only the sewing head being indicated.

The automatic sewing machine shown in the drawing has a stand 1 consisting of a central section 2 and two lateral sections 3 and 4. Arranged on the central section 2 of the stand 1 is a sewing head 5, the base plate 6 of which is fixed on to the central section. In addition, the sewing head 5 has a standard 7 which projects upward from the base plate 6 and from which an upper arm 8 projects above and parallel to the base plate 6. Stitch forming tools 9 are arranged in the area of the free ends of the base plate 6 and arm 8. A workpiece holder 10 is arranged between the base plate 6 and the arm 8—that is, in the region of the stitch forming tools 9. This workpiece holder is movable in two coordinate directions, that is in the y direction which corresponds approximately to the main direction of the sewing head 5, and in the x direction which is perpendicular thereto, as can be seen from FIG. 2. For this purpose the workpiece holder 10 is fitted on an x-y carriage system. This system has a y carriage 11 which directly carries the workpiece holder 10 and which is supported and guided on an x carriage 12 and is displaceable relative thereto in the y direction. The x carriage 12 is in turn displaceable in the x direction relative to the stand 1. The y carriage 11, together with the workpiece holder 10, is therefore displaceable relative to the stand 1 in the x and y directions.

The x carriage 12 is arranged so as to be displaceable on two guide rods 13 which are rigidly attached to the stand 1 and run parallel to one another. These guide rods 13 are retained by their respective ends in bearing webs 14, 14' of pillow blocks 15, 15' which are attached to the two lateral sections 3 or 4, respectively, of the stand 1 by means of screws 16.

Figure 2:
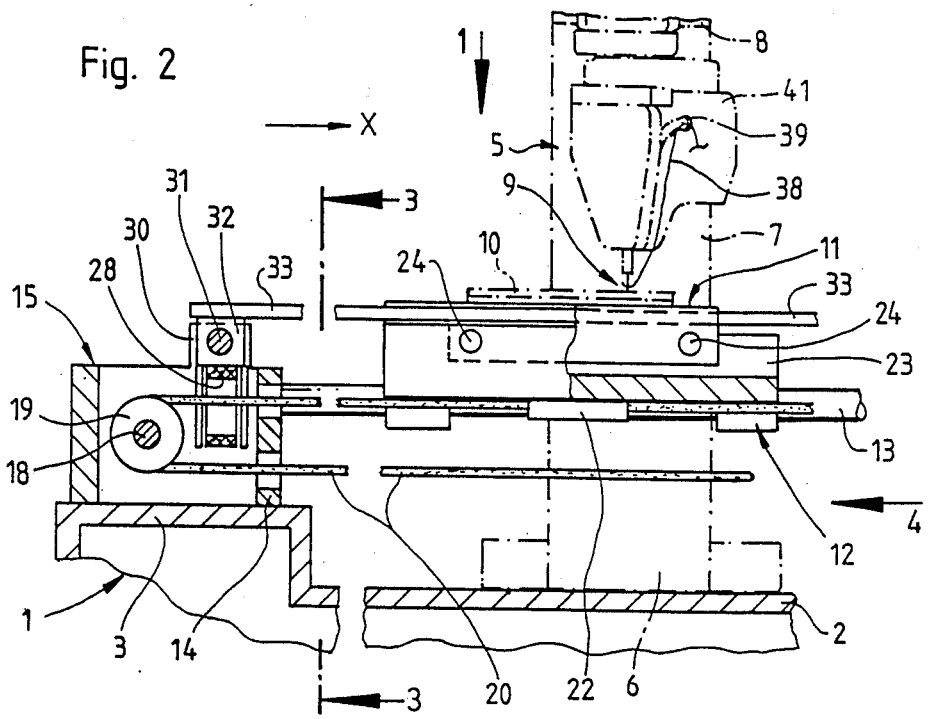
FIG. 2 shows a vertical partial section along the line II—II in FIG. 1.
Figure 3:
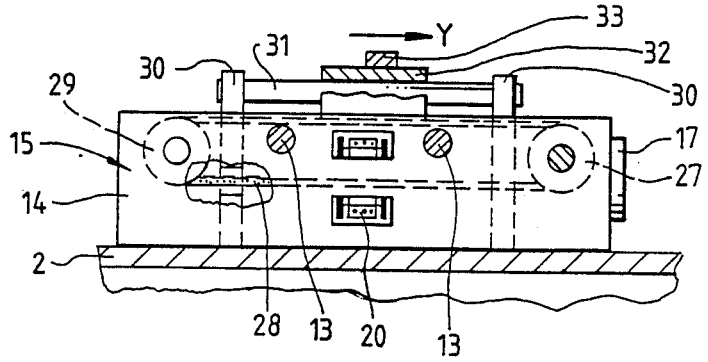
FIG. 3 shows a vertical partial section along the line III—III in FIG. 2.
Figure 4:
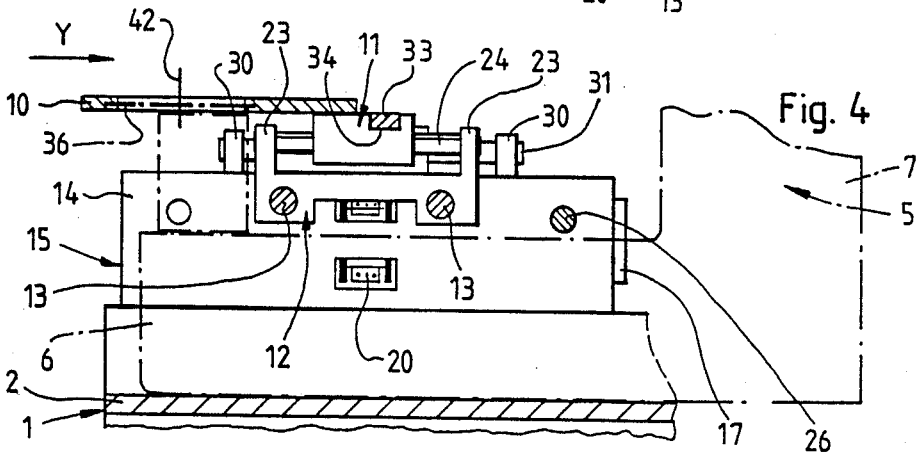
FIG. 4 shows a partial side view in the direction of arrow IV in FIG. 2.

A drive motor 17 for the x carriage 12 is mounted on one pillow block 15—which is associated with the left lateral section 3 in FIGS. 1 and 2. This motor drives a timing belt pulley 19 via a shaft 18 mounted in the pillow block 15. This pulley in turn drives an endless timing belt 20 which is guided over a timing belt pulley 19'. This timing belt pulley 19' is mounted by means of an axle 21 so as to be freely rotatable in the pillow block 15' in the other lateral section 4 of the stand 1. The upper side of this timing belt 20 is attached to the underside of the x carriage 12 by means of a fastening element 22 so that this carriage is displaced on the guide rods 13 in the x direction upon appropriate driving of the drive motor 17.

The x carriage 12 has side walls 23 extending in the x direction and bearing guide rods 24 which extend in the y direction and on which the y carriage 11 is mounted so as to be slidable in the y direction.

The y carriage 11 is driven via a drive motor 25 which is attached to the pillow block 15' and which directly drives a shaft 26 mounted in the two pillow blocks 15, 15'. This shaft extends in the x direction. Rigidly mounted in the two pillow blocks 15, 15' on this shaft 26 are timing belt pulleys 27 and 27' which drive endless timing belts 28 and 28', respectively. Each of these timing belts 28 or 28' is guided via respective timing belt pulleys 29 and 29' mounted for free running also in corresponding pillow blocks 15 and 15', respectively. Guide rods 31, 31', on which respective sliding bearings 32, 32' are mounted so as to be slidable in the y direction, are arranged parallel and above the timing belts 28, 28' in respective webs 30, 30' of each pillow block 15, 15'. The two sliding bearings 32, 32' lying opposite one another are connected by means of a guide rail 33 which extends in the x direction and which is screwed by its respective ends on to the corresponding sliding bearing 32 or 32'. This guide rail 33 engages in a guide groove 34, which is adapted to the outer circumference of the rail, in the upper side of the y carriage 11. The guide groove 34 and the guide rail 33 are free from play in the y direction. A tilt-free drive of the y carriage in the y direction is achieved by driving the guide rail 33 in the y direction, i.e. at right angles to its longitudinal direction, by the timing belts 28, 28' engaging on the two rail ends via the sliding bearings 32, 32'. Movements of the y carriage 11 in the x direction, together with the x carriage 12, are easily possible because the guide rail 33 is absolutely parallel to the guide rods 13, whereas a trouble-free drive and trouble-free guidance in the y direction means that the guide rods 31, 31' are absolutely parallel to the guide rods 24.

In this case the drive motors 17 and 25 can be stepping motors or direct current motors with position feedback which create a very precise program-controlled drive of the x carriage 12, y carriage 11 and thus of the workpiece holder 10 in the x-y direction.

A control unit 35 having means of recording a program P is provided for the program-controlled drive. A workpiece 36 in which a seam 37 is produced by means of stitch forming tools 9 is retained in the workpiece holder 10, and this will be explained in detail further on. For this purpose a needle thread 38 is guided from a thread reel (not shown) via a thread take-up lever 39 to the stitch forming tools 9.

Figure 5:
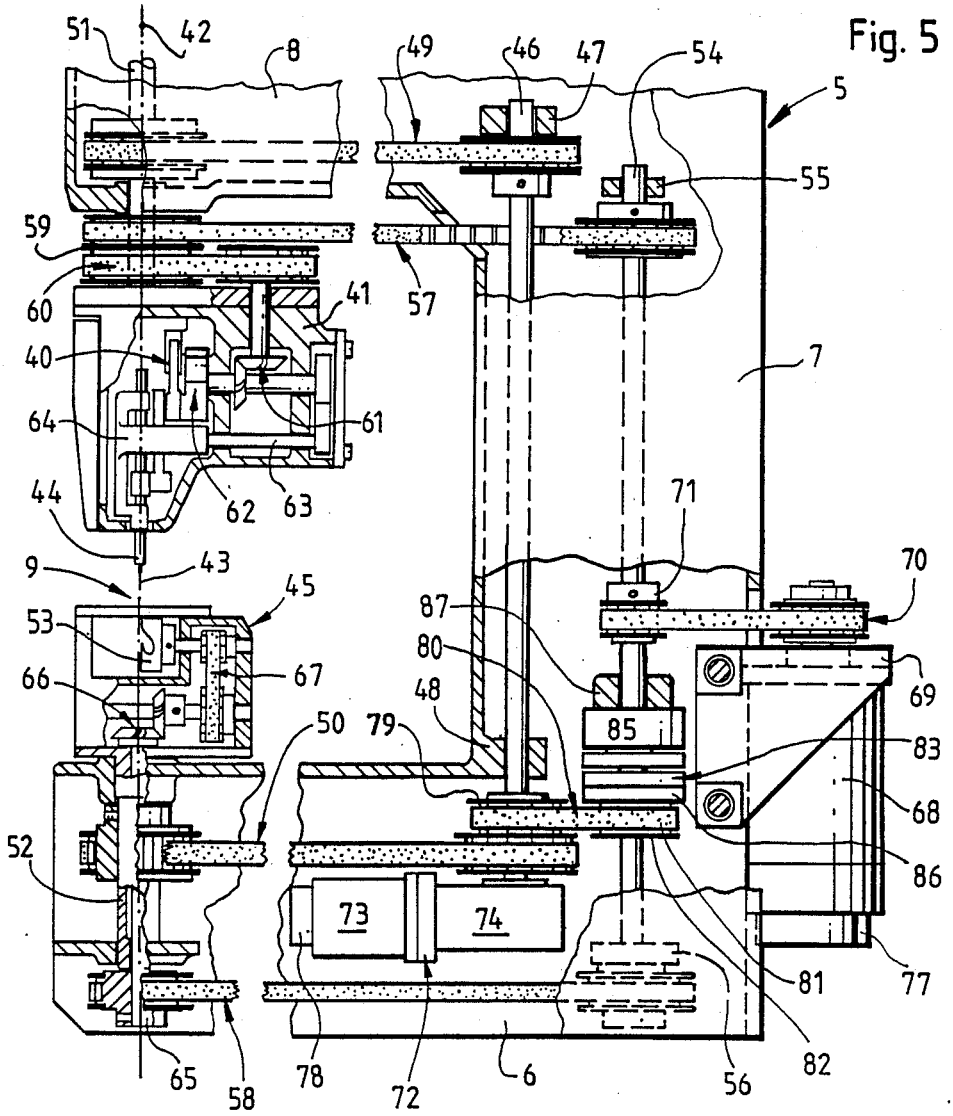
FIG. 5 shows a vertical section through the sewing head having a partially broken-away upper arm.

The design of the sewing head 5 can be seen essentially in FIG. 5. On the underside of the free end of the arm 8 a rotary housing 41 is mounted so as to be rotatable about an axis 42. Also, a needle 43 and a needle bar 44 bearing this needle are arranged in this axis 42. A hook bearing 45 which is pivotable with the same angle of rotation as the rotary housing, is arranged below the rotary housing 41 and also in alignment with the axis 42 on the base plate 6 which is in the form of a housing. The tilt drive of the rotary housing 41 and hook bearing 45 is effected by an adjusting shaft 46 arranged in the standard 7 parallel to the axis 42 and mounted in bearings 47, 48. Timing belt drives 49, 50 are driven by both ends of the control shaft 46. The timing belt drive 49 in the arm 8 drives the rotary housing via a shaft 51 which is concentric with the axis 42. The lower timing belt drive 50 which is situated in the base plate 6 drives the hook bearing 45 via a hollow shaft 52. Because the two timing belt drives 49, 50 have an identical transmission ratio, the rotary housing 41 and the hook bearing 45 are each driven with the same angle of rotation.

The drive of the needle bar 44 and needle 43, on the one hand, and that of the hook 53 in the hook bearing 45 are effected from a common drive shaft 54 acting as the main drive shaft. This shaft is mounted in the standard 7 by means of bearings 55, 56 and runs parallel to the adjusting shaft 46. It drives the needle bar 44 and the hook 53 via two timing belt drives 57, 58, respectively, situated in the area of the shaft ends. The upper timing belt drive 57 associated with the arm 8 ends in a double timing belt pulley 59 which is concentric with the shaft 51 and thus with the axis 42 and which is not connected to the shaft 51. A bevel gear drive 61 in the rotary housing 1 is driven by this double timing belt pulley 59 via another timing belt drive 60 situated on the upper side of the rotary housing 41. This bevel gear drive 61 in turn drives a crank mechanism 62 which imparts to the needle bar 44 its up-and-down motion. The bevel gear drive 61 also drives an oscillating shaft 63 which imparts an oscillating motion, i.e. a so-called needle transfer motion, to the needle bar 44 via a needle bar jogging frame 64. In addition, a thread lever mechanism 40 serving to drive the take-up lever 39 is driven by the crank mechanism 62. The lower timing belt drive 58 situated in the base plate 6 drives a hook driving shaft 65 which is situated in the hollow shaft 52 and which drives the hook 53 via a bevel gear drive 66 situated on the hook bearing 45 and another timing belt drive 67. The design and drive of the rotary housing 41 including the needle bar 44 mounted therein, the needle bar jogging frame 64 and thread lever mechanism 40 and the design and drive of the hook bearing 45, including the driving of the hook 53, mounted therein, by the adjusting shaft 46 or drive shaft 54, is known from U.S. Pat. No. 4,574,718, to which specific reference is made in order to avoid repetition.

A drive motor 68 mounted on a flange 69 of the standard 7 serves as the drive. A timing belt drive 70 leads from the drive motor 68 to a timing belt pulley 71 which is non-rotatably mounted on the drive shaft 54. The adjusting shaft 46 is driven by way of a self-locking actuating drive 72 which is arranged in the housing-shaped base plate 6 and which consists essentially of an electric motor 73 with a following reducing gear 74. Drive motors 17, 25, 68, 73 are provided with rotary position indicators 75, 76, 77, 78, respectively, which, upon rotation of each motor shaft, transmit a preset number of pulses so that the angular position of each motor can be detected.

A driving pinion 79 of a compensating type of timing belt drive 80 is rotatably mounted on the adjusting shaft 46. The timing belt 81 of this timing belt drive 80 is guided around an internal gear 82 of the timing belt which therefore serves as the driven pulley of the timing belt drive 80. This timing belt internal gear 82 is part of a clutch 83, the clutch disc 84 of which is non-rotatably mounted on the drive shaft 54. This clutch 83 also has an electric clutch magnet 85, upon the excitation of which the internal gear 82 provided with a clutch abutment 86 is non-rotatably connected to the clutch disc 84 and thus to the drive shaft 54. The clutch magnet 85 is rigidly fixed in the standard 7 by way of a supporting bearing 87.

Figure 6:
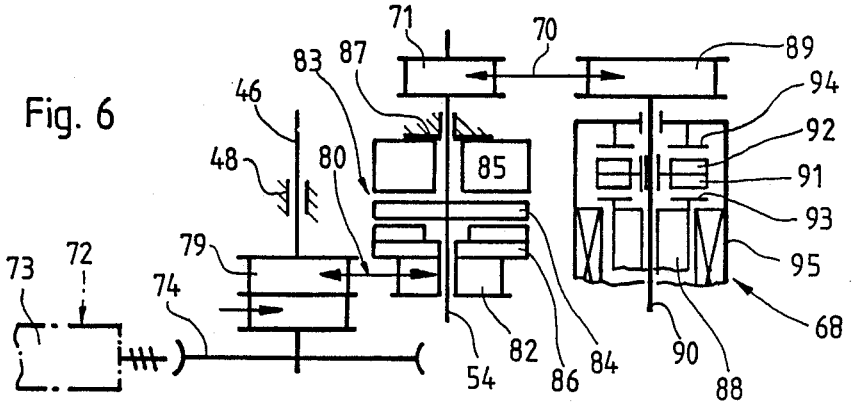
FIG. 6 shows a partial diagrammatic view from FIG. 5.

The drive motor 68 is in the form of a clutch brake motor having a continuously driven rotor 88. It has an output shaft 90 which bears a drive belt pulley 89 of the timing belt drive 70 and on which a clutch disc 91 and a brake disc 92 are each rigidly mounted. The clutch disc 91 can engage with the disc flywheel 93 of the rotor 88 while the tension disc 92 can be brought into engagement with a brake abutment 94 which is non-rotatably connected to the housing 95 of the drive motor 68. If the clutch disc 91 is connected to the rotor 88, driving of the drive shaft 54 takes place. If the tension disc 92 is connected to the brake abutment 94, the drive shaft 54 is non-rotatably fixed by way of the timing belt drive 70. If, on the other hand—as indicated in FIG. 6—neither the tension disc 92 engages with the brake abutment 94, nor the the clutch disc 91 with the disc flywheel 93, the drive motor 68 is released, i.e. the drive shaft 54 can in principle be freely rotated. Drive motors 68 of this type are widely used particularly for driving sewing machines and are generally known as so-called position motors. It should be added that the rotary position transmitter 77 is connected to the output shaft 90, and therefore detects only the rotation of this shaft.

In another exemplary embodiment the driving connection, which can be switched on, between the adjusting shaft 46 and drive shaft 54 is not required. Otherwise, the sewing head is identical in design to that shown in FIG. 5. Therefore, only the areas where changes from FIG. 5 have been effected are shown broken away in FIG. 7. It can be seen that the clutch and the compensating type timing belt drive 80 are omitted.

On the other hand, a clamping device 96 is attached to the rotary housing 41. This device has a double-armed lever 97 which is pivotably mounted on the rotary housing in a bearing 98. At one end the lever 97 is provided with a brake shoe 99 which can be pressed against the timing belt drive 60, by means of which therefore the timing belt drive 60 can be locked relative to the housing 41. A linear clamping drive 100 engages on the other lever end and is in the form of a single-acting pneumatically operatable working cylinder, but in this case can also be an electromagnet.

Figure 8:
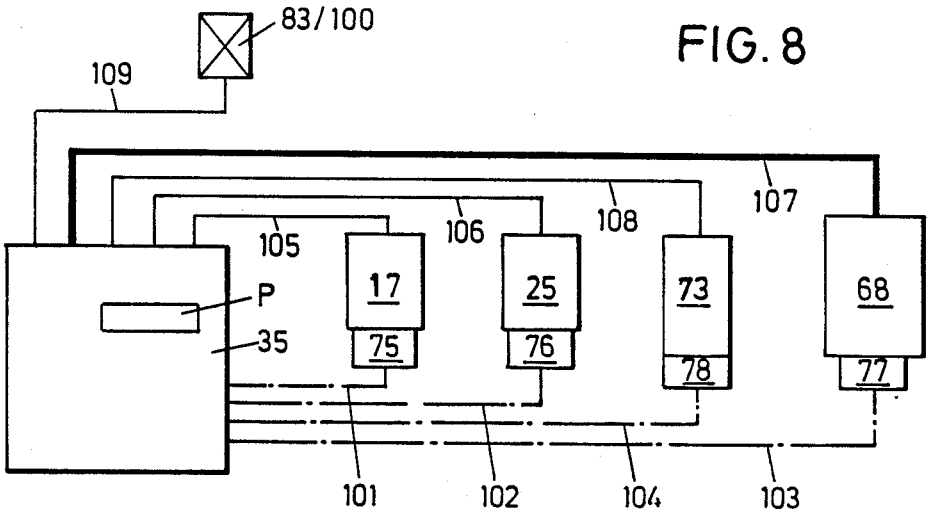
FIG. 8 shows a block diagram-like view of the various drive motors with associated rotary position indicators and a control unit.

As can be seen from FIG. 8, the rotary position transmitters 75 to 78 are connected to the control unit 35 by way of position feedback lines 101, 102, 103, 104. On the other hand, the motors 17, 25, 68, 73 are connected to the control unit 35 via lines 105, 106, 107, 108.

Furthermore, the control unit 35 is connected to the clutch 83 or the clamping drive 100 via a control line 109; the diagrammatic view in FIG. 8 covers both versions in this respect.

In the event of a pivoting movement of the rotary housing 41 the needle bar 44, the thread lever mechanism 40 and the needle bar jogging frame 64 execute a movement by virtue of the rolling movement of the timing belt drive 60 on the double timing belt pulley 59. Likewise, the hook 53 rotates by virtue of a rolling motion in the bevel gear drive 66. This results in a change in the position of the needle 43 and hook 53 which, with the machine running without any correcting action, leads to a change in the stitch length, and the greater the angle of rotation of the rotary housing 41 and hook bearing 45 is per stitch, the greater the change in stitch length. With the machine stationary and the workpiece 36 rotating at the same time as the rotary housing 41 rotates together with the hook bearing 45, the height of the needle 43 again changes, which is likewise undesirable particularly when producing so-called corner stitches with the needle 43 inserted into the workpiece 36. The clutch 83 having the compensating type timing belt drive 80, on the one hand, and the clamping device 96, on the other hand, serve to prevent this last mentioned change in the height of the needle 43.

Figure 9:
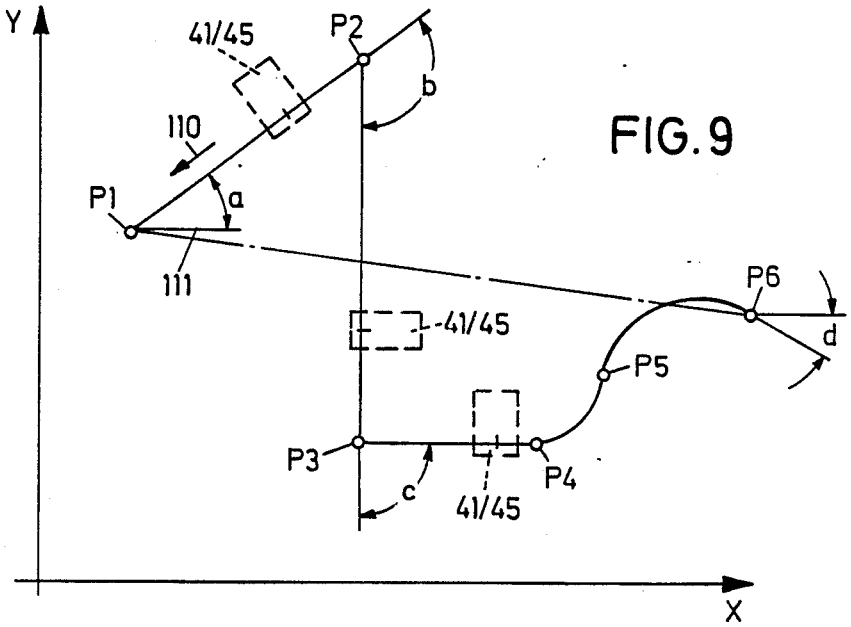
FIG. 9 shows a diagrammatic view of a seam path in the x-y plane.

FIG. 9 shows a seam path which necessitates pivoting movements of the rotary housing 41 resulting in changes in stitch length. Furthermore the mentioned corner stitches which would result in undesirable changes in the height of the needle 43 are executed in this case. The seam 37 is characterised by six supporting points P1 to P6. From the starting point P1 of the seam, a straight-line seam is sewn as far as supporting point P2, for which purpose the workpiece 36 is guided relative to the rotary housing 41 in the direction of arrow 110.

The rotary housing 41, which is shown by broken lines several times in the drawing, has in this case an angle a relative to a normal starting position 111. During this sewing operation from P1 to P2 the rotary housing 41 and the hook bearing 45 are not rotated, i.e. the actuating drive 72 is inoperative. Only driving of the drive shaft 54 by the drive motor 68 and, from there, the needle bar 44 and the associated units are driven via the timing belt drive 57 and the hook 53 is driven via the timing belt drive 58.

When the supporting point P2 is reached, the drive shaft 54 is stopped by appropriate triggering of the drive motor 68 or its brake 92/94, the needle 43 being engaged in the workpiece 36. Now the actuating drive 72 is triggered and turns the adjusting shaft 46 and, by way of this shaft, the rotary housing 41, on the one hand, and the hook bearing 45, on the other.

In order to prevent an upward movement of the needle bar 44 and needle 43, which is caused by the described rolling actions, and corresponding turning of the hook 53, the clutch 83 in the embodiment according to FIG. 5 is closed by excitation of the magnet 85 prior to the actuating drive 72 being triggered. At the same time the tension disc 92 is disengaged from the brake abutment 94, i.e. the drive 68 is released. If the actuating drive 72 is now brought into operation, the main drive shaft 54 is rotated at the same angular speed as the adjusting shaft 46 by the compensating type timing belt drive 80. For this purpose the compensating type timing belt drive 80 has a transmission ratio of 1:1, i.e. the driving pinion 79, on the one hand, and the timing belt internal gear 82 are designed identically on their outer circumferences. The displacement of the needle 43 and hook bearing 45, which is inititiated as such by the rolling motion, is compensated for by this driving connection between the adjusting shaft 46 and drive shaft 54.

Figure 7:
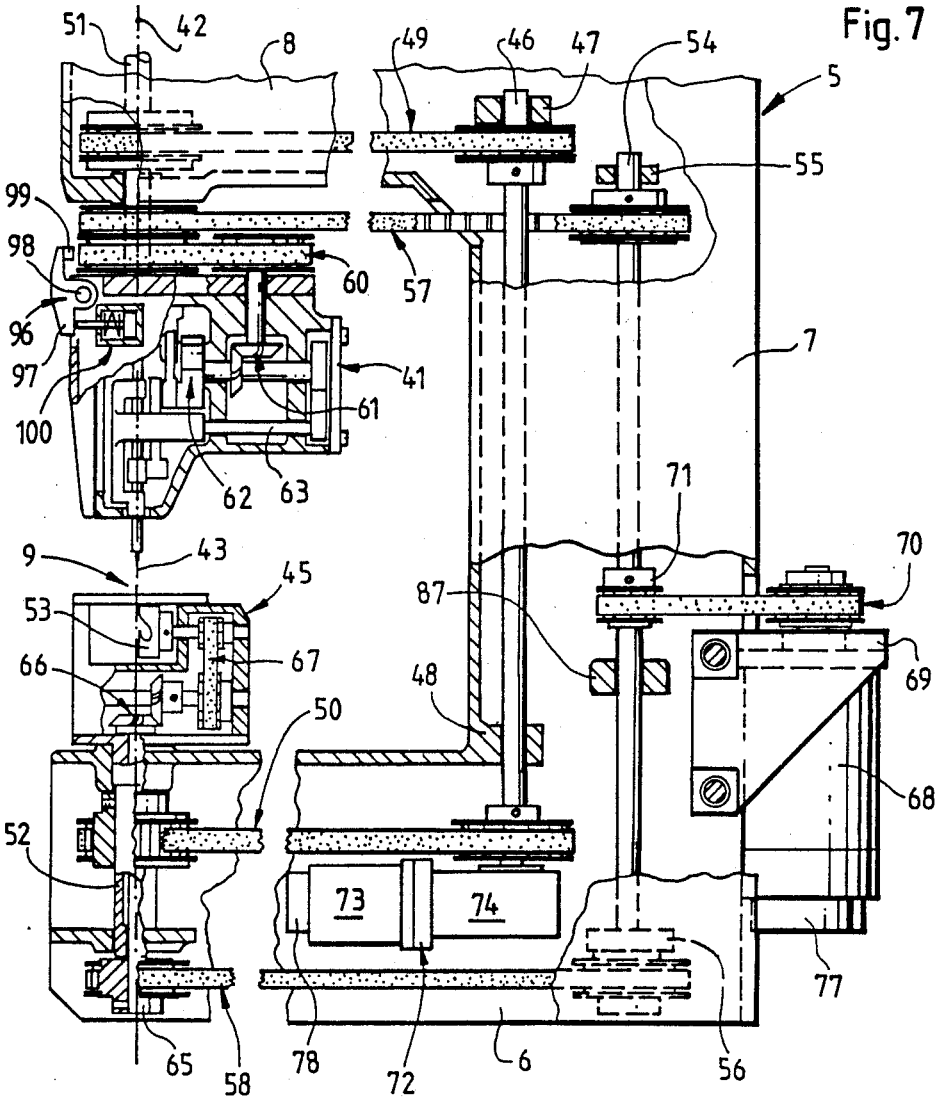
FIG. 7 shows a modified embodiment, with the standard being shown only partly broken away.

In the embodiment according to FIG. 7 the drive motor 68 is disengaged in the already described manner after stopping of the needle 43 and before switching on of the actuating drive 72 and the clamping device 96 is closed by actuating the clamping drive 100 so that the belt drive 57 is locked relative to the rotary housing 41. This therefore prevents the double timing belt pulley 59 from rotating relative to the rotary housing 41; the timing belt drive 60 is also locked in this way; movement of the needle bar 44 does not therefore take place because one of the described rolling movements does not occur. On the contrary, the drive shaft 54 is rotated under no load with the same angle of rotation and at the same angular speed as the adjusting shaft 46.

At the supporting point P2 the rotary housing 41 is rotated through an angle b relative to the workpiece 36. Then the seam 37 is sewn further in a straight line as far as the supporting point P3. At this point a corner stitch is executed in the same manner as at supporting point P2 and the rotary housing 41 is rotated through an angle c relative to the workpiece 36. Then sewing continues in a straight line as far as supporting point P4. From this point the seam 37 does not run in a straight line, i.e. in this part of the seam the rotary housing 41 is pivoted relative to the workpiece 36 during the sewing operation. In this case the clutch 83 or the clamping device 96 is opened. The subsequent guiding of the rotary housing 41 is effected by appropriate triggering of the actuating drive 72. The manner in which triggering is effected in detail does not form part of the invention and, moreover, is shown and described in detail in U.S. Pat. No. 4,787,326 to which reference may be made.

After reaching supporting point P6, i.e. at the end of the seam, the needle bar 44 with the needle 43 is moved into the so-called "needle high" position. Then the sewing head 5 is moved back into the starting position P1 without a sewing action. In this case the rotary housing 41 is swung back simultaneously through an angle d+a into its starting position. Upon this return swing movement by means of the actuating drive 72 the clutch 83 and the clamping device 96 are again closed and the drive motor 68 is disengaged so that the height of the needle 43 does not change during this pivoting movement.

As demonstrated by the preceding explanations, rotation of the released output shaft 90 and thus rotation of the rotary position transmitter 77 during pivoting of the rotary housing 41 and hook bearing 45 are effected by both embodiments according to FIGS. 5 and 6, on the one hand, and according to FIG. 7, on the other. The pulses which are transmitted at the same time by the rotary position transmitter 77 are ignored by the control unit 35. The new position occupied by the output shaft 90 after the turning of the rotary housing 41 and hook bearing 45 is terminated is then in turn interpreted by the control unit 35 as the starting position or "needle low" position.

What is claimed is:

1. An automatic sewing device with a sewing head (5) and a device for generating a two-axis-relative movement between the sewing head (5) and a workpiece (36) to be sewn, said sewing head (5) including:

a rotary housing (41) supported at said sewing head (5) and drivable in a swivelling manner about an axis of rotation by an adjusting shaft (46), said rotary housing (41) having:

a needle bar (44) with a needle (43) supported in said rotary housing (41) and reciprocatingly drivable via a crank drive (62) driven by a common drive, which common drive is drivable by a drive shaft (54) of said sewing head (5), the needle having a needle axis (42) being identical with said axis of rotation, a needle jogging gear (63, 64) connected to said crank drive (62) for generating a needle feed movement, and a thread take-up lever drive (40) coupled to said crank drive (62), a hook bearing (45) drivable in a swivelling manner by said adjusting shaft (46) about said needle axis (42) equiangularly to said rotary housing (41), a hook (53) arranged in said hook bearing (45) and drivable by said drive shaft (54), a drive motor (68) for driving said drive shaft (54), an actuating drive (72) for driving said adjusting shaft (46), a device for a drive-like connection of the adjusting shaft (46) and the drive shaft (54), and a device for the disengaging of the drive motor (68) from the drive shaft (54).

2. An automatic sewing device according to claim 1, wherein said devices can be actuated simultaneously.

3. An automatic sewing device according to claim 1, wherein the drive motor (68) is in the form of a clutch brake motor.

4. An automatic sewing device according to claim 1, wherein the device for a drive-like connection of the adjusting shaft (46) and the drive shaft (54) comprises a driving connection which connects directly the adjusting shaft (46) and the drive shaft (54) and has an actuatable clutch (83).

5. An automatic sewing device according to claim 4, wherein said driving connection comprises a compensating-type timing belt drive (80) having a transmission ratio of 1:1.

6. An automatic sewing device according to claim 4, wherein the clutch (83) can be actuated electromagnetically.

7. An automatic sewing device according to claim 1, wherein said common drive formed by a timing belt drive (57) and said device for the drive-like connection of the adjusting shaft (46) and the drive shaft (54) comprises a device for locking the timing belt drive (57) relative to the rotary housing (41).

8. An automatic sewing device according to claim 7, wherein the locking device is in the form of a clamping device (96) which is arranged on the rotary housing (41) and has a brake shoe (99) which can be pressed against the timing belt drive (57).

9. An automatic sewing device according to claim 8, wherein the clamping device (96) has a double-armed lever (97) which is pivotably mounted on the rotary housing (41) and to one end of which the brake shoe (99) is attached an on the other end of which a linear clamping drive (100) engages, which drive is arranged on the rotary housing (41).

* * * * *